United States Patent [19]

Garwin et al.

[11] 4,389,302

[45] Jun. 21, 1983

[54] PROCESS FOR VIS-BREAKING ASPHALTENES

[75] Inventors: Leo Garwin, Oklahoma City; Roger A. Baldwin, Warr Acres, both of Okla.

[73] Assignee: Kerr-McGee Refining Corporation, Oklahoma City, Okla.

[21] Appl. No.: 263,977

[22] Filed: May 15, 1981

[51] Int. Cl.[3] ..... C10G 55/04; C10G 9/14

[52] U.S. Cl. ..... 208/86; 208/87; 208/96; 208/106; 208/314

[58] Field of Search ..... 208/86, 87, 314, 96

[56] References Cited

U.S. PATENT DOCUMENTS

| | | | |
|---|---|---|---|
| 2,240,008 | 4/1941 | Atwell | 208/86 |
| 2,608,470 | 8/1952 | Helmers et al. | 208/96 |
| 2,695,264 | 11/1954 | Taff et al. | 208/88 |
| 2,900,327 | 8/1959 | Beuther | 208/106 |
| 2,940,920 | 6/1960 | Garwin | 208/45 |
| 3,053,750 | 9/1962 | Beuther et al. | 208/45 |
| 3,234,118 | 2/1966 | Chen | 208/93 |
| 3,310,484 | 3/1967 | Mason et al. | 208/125 |
| 3,338,818 | 8/1967 | Paterson | 208/58 |
| 3,349,024 | 10/1967 | Mayhue | 208/95 |
| 3,472,760 | 10/1969 | Paterson | 208/86 |
| 3,532,618 | 10/1970 | Wunderlich et al. | 208/14 |

*Primary Examiner*—Delbert E. Gantz
*Assistant Examiner*—O. Chaudhuri
*Attorney, Agent, or Firm*—William G. Addison

[57] ABSTRACT

A process for producing additional liquid products from a heavy hydrocarbon material by vis-breaking of a separated asphaltene-containing fraction under controlled conditions of temperature and pressure. The asphaltene-containing fraction is obtained by contacting the heavy hydrocarbon material with a first solvent under elevated temperature and pressure conditions to separate the asphaltenes as a heavy phase from the remainder of the heavy hydrocarbon material. The products of the vis-breaking operation comprise distillable and substantially nondistillable liquid products in association with a residue including organometallic compounds. The distillable and substantially nondistillable liquid products then are separated from the residue. The distillable products can be separated by distillation. The nondistillable products are separated from the residue employing a second solvent maintained under elevated temperature and pressure conditions and then recovered as a liquid phase product.

25 Claims, 1 Drawing Figure

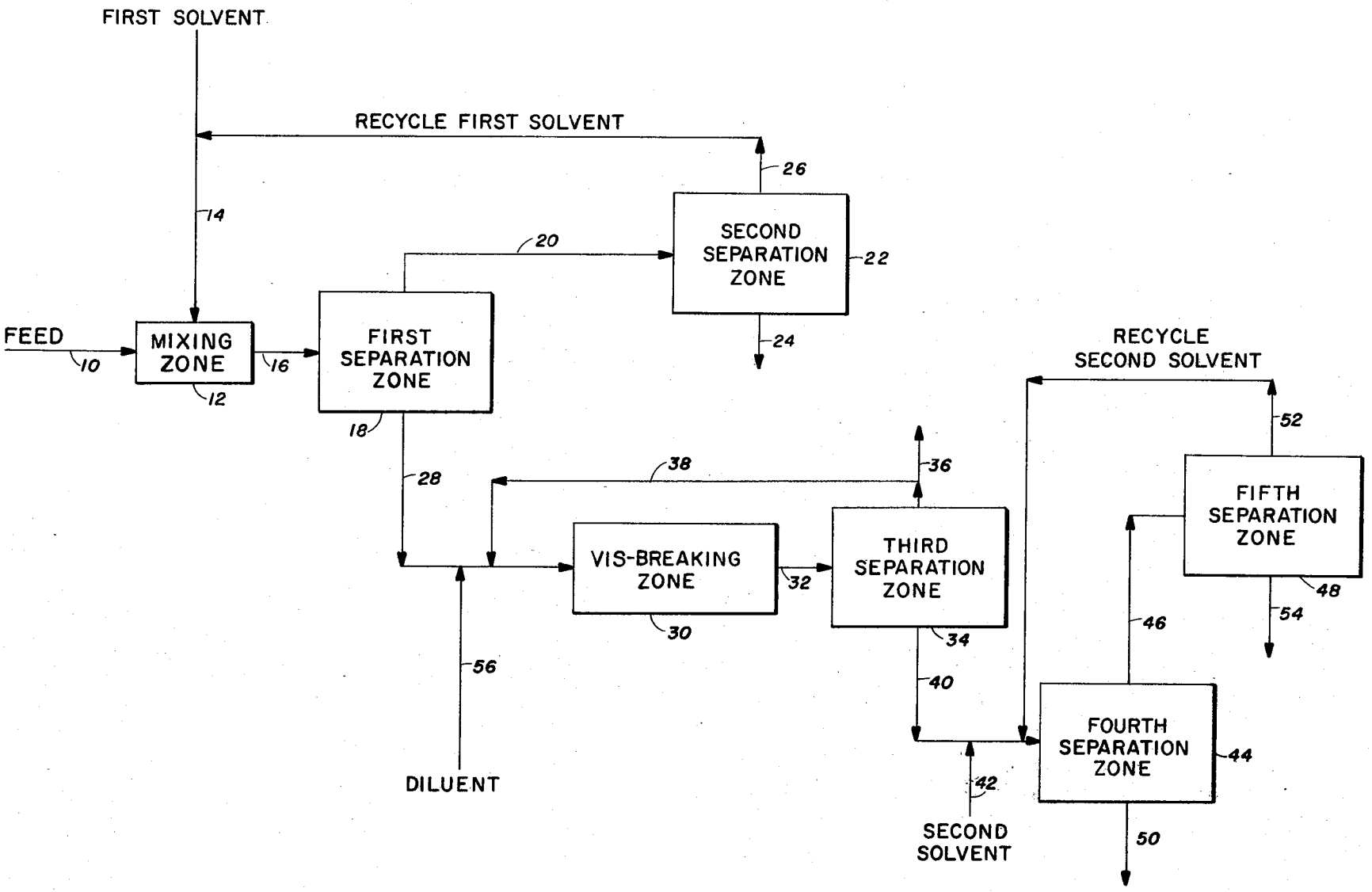
FEED
10
FIRST SOLVENT
14
MIXING ZONE
12
16
FIRST SEPARATION ZONE
18
20
SECOND SEPARATION ZONE
22
24
26
RECYCLE FIRST SOLVENT
28
VIS-BREAKING ZONE
30
32
38
THIRD SEPARATION ZONE
34
36
40
42
SECOND SOLVENT
56
DILUENT
FOURTH SEPARATION ZONE
44
46
50
FIFTH SEPARATION ZONE
48
52
54
RECYCLE SECOND SOLVENT

PROCESS FOR VIS-BREAKING ASPHALTENES

BACKGROUND OF THE INVENTION

1. Field of the Invention

This invention relates to a process for separating a fraction substantially comprising asphaltenes from heavy hydrocarbon materials and then treating the separated fraction to crack and vis-break the same to produce additional liquid products having a reduced metals content.

2. Brief Description of the Prior Art

Many methods of extracting various fractions from bituminous materials have been disclosed previously in the prior art. Perhaps the most well known of these is termed "propane extraction" in which asphaltic materials are separated from heavy hydrocarbons to produce deasphalted oils and an asphaltene-containing residue by means of a single solvent extraction step using propane as the extractant.

In that it is desirable to obtain the greatest possible quantity of oils from a heavy hydrocarbon material such as a reduced crude, other extraction techniques have been developed. U.S. Pat. No. 2,940,920, assigned to the same assignee as is the present invention, discloses a process capable of effecting a deeper cut in heavy hydrocarbon materials than is available by means of propane extraction. That patent discloses effecting the separation by using high temperature-pressure techniques and by using pentane as one of a group of suitable solvents. Such practice permits a deeper cut to be made in the heavy hydrocarbon material and produces an asphaltene-containing residue having a higher viscosity than that produced by propane extraction.

Normally, the asphaltene-containing residue also will contain a substantial portion of any organometallic compounds which are present in the heavy hydrocarbon material. This residue, because of its high viscosity and metals content, has limited commercial utility. The residue can be used as a soil conditioner, asphalt hardener, printing ink pigment, paper sizing agent and solid granular insulator. The physical and chemical properties of the residue substantially limit its use as a liquid fuel even when diluted with hydrocarbon cutter stocks.

It would be desirable to convert the asphaltene-containing residue into lighter products by vis-breaking or thermal pyrolysis under controlled conditions to acceptable lower viscosity products suitable for use as liquid fuels. Various processes for vis-breaking heavy hydrocarbon materials by thermal pyrolysis are disclosed in U.S. Pat. Nos. 2,695,264; 2,900,327; 3,234,118 and 3,349,024.

Prior attempts to produce liquid products from asphaltenes have had limited success. When an attempt has been made to vis-break or thermally pyrolyze the asphaltenes, coking has occurred in the process equipment. Coking occurs when a feed is not maintained in a turbulent flow condition within the process equipment at the high temperatures at which the equipment operates. The high viscosity of the asphaltenes impedes maintaining the same in the turbulent flow condition necessary to prevent coking. This results in a low yield of desired vis-broken product and a short on-stream time before coking of the feed causes a termination of process operation. The coke then must be removed from the equipment manually or by burnout with injected air.

SUMMARY OF THE INVENTION

The discovery now has been made that it is possible to treat a heavy hydrocarbon material by the process hereinafter described to effect a deep oil cut in the heavy hydrocarbon material and then treat the asphaltene-containing residue by vis-breaking under controlled conditions to produce additional liquid products while eliminating or substantially reducing coking in the vis-breaking equipment.

The process comprises contacting the heavy hydrocarbon material with a first solvent in a mixing zone to provide a mixture for introduction into a first separation zone. The first separation zone is maintained at an elevated temperature and pressure to effect a separation of the mixture into a fluid-like first light phase comprising first solvent, oils and resins and a fluid-like first heavy phase comprising asphaltenes containing the bulk of the organometallic compounds present and some first solvent. The first light phase is withdrawn from the first separation zone and introduced into a second separation zone for additional fractionation or recovered as a product. The first heavy phase then is introduced into a vis-breaking zone in which it is heated to an elevated temperature under high pressure to effect thermal cracking of the asphaltenes. The pressure in the vis-breaking zone is sufficient to prevent the formation of any separate vapor phase at the highest temperature within said vis-breaking zone. The products of the vis-breaking zone are withdrawn from the zone as a single condensed phase and introduced into a third separation zone.

In the third separation zone, the vis-breaking zone products are flashed in one or more stages, the last stage preferably being under vacuum to separate at least a portion of any distillable liquid and gaseous products including first solvent from any substantially nondistillable liquid products and residue. The remainder then is contacted with a second solvent and introduced into a fourth separation zone that is maintained at an elevated temperature and pressure.

The remainder separates within the fourth separation zone into a fourth light phase comprising a liquid product comprising substantially nondistillable products, any distillable products and second solvent and a fourth heavy phase comprising the residue which comprises residual asphaltenes, organo-metallic compounds, coke, catalyst fines, if any, and other heavy carbonaceous materials. The fourth light phase is withdrawn from the fourth separation zone and introduced into a fifth separation zone.

The fifth separation zone is maintained under suitable conditions of temperature and pressure to effect a separation of the fourth light phase into a fifth light phase comprising second solvent and a fifth heavy phase comprising liquid products of the vis-breaking process. The second solvent is recycled in the process and the vis-breaking liquid products are recovered for use as a liquid fuel having a reduced metals content.

BRIEF DESCRIPTION OF THE DRAWING

The single drawing is a diagramatic illustration of the process of this invention.

DESCRIPTION OF THE PREFERRED EMBODIMENT

Turning now to the drawing, the process of the present invention is illustrated. A feed stock comprising a heavy hydrocarbon material comprising asphaltenes and either or both resins and oils is introduced into a mixing zone 12 through a conduit 10. A first solvent is introduced into mixing zone 12 through a conduit 14 to contact and admix with the feed to provide a mixture. Sufficient first solvent is introduced into mixing zone 12 to provide a ratio by volume (measured at ambient temperature conditions) of solvent to feed in the mixture in the range of from about 2:1 to about 20:1 and preferably in the range of from about 8:1 to about 12:1. It is to be understood that larger quantities of the first solvent may be used, but such use is not particularly advantageous.

The term "first solvent" as used herein means a fluid comprising at least one member selected from the group consisting of: paraffin hydrocarbons containing from 4 through 9 carbon atoms, such as pentane, hexane, heptane, octane and nonane; cycloparaffin hydrocarbons containing fewer than 10 carbon atoms, such as, cyclopentane, cyclohexane and their methyl derivatives; mono-olefin hydrocarbons containing from 4 through 8 carbon atoms, such as butene, pentene, hexene, heptene and octene and any other fluid known to those skilled in the art which is capable of dissolving at least a portion of the heavy hydrocarbon material feed and then is capable of separation from said dissolved feed.

The mixture then is passed into a first separation zone 18 via a conduit 16. The first separation zone 18 is maintained at an elevated temperature and pressure to effect a separation of the mixture into a fluid-like first light phase comprising first solvent, oils and resins and a fluid-like first heavy phase comprising asphaltenes, organometallic compounds and some first solvent. As previously indicated, a substantial portion of the organometallic compounds present in the heavy hydrocarbon material are associated with the asphaltenes.

More particularly, first separation zone 18 is maintained at a temperature level in the range of from about 150° F. to about the critical temperature of the first solvent and a pressure level at least equal to the vapor pressure of the first solvent when at a temperature below the critical temperature of the first solvent and at least equal to the critical pressure of the first solvent when at a temperature equal to or above the critical temperature of the first solvent. Preferably, the temperature level is maintained within a range of from about 50° F. below the critical temperature of the first solvent to about 50° F. above the critical temperature of the first solvent. Preferably, the pressure level is maintained at or above the critical pressure of the first solvent.

Alternatively, the heavy hydrocarbon material and first solvent can be introduced directly into first separation zone 18 in the ratios previously described but at different points therein, without prior admixing and then the separation can take place as previously described.

The first light phase is withdrawn from first separation zone 18 through a conduit 20 and recovered. In one embodiment, the separated first light phase is passed from first separation zone 18 through conduit 20 and introduced into a second separation zone 22. The second separation zone 22 is maintained at a temperature level higher than the temperature level in the first separation zone 18 and at an elevated pressure to effect a separation of the first light phase into a fluid-like second light phase comprising first solvent and a fluid-like second heavy phase comprising oil, resins and some first solvent. Preferably, the temperature level in second separation zone 22 is maintained in a range of from about 5° F. to about 100° F. above the temperature in first separation zone 18 and most preferably at a temperature of from about 5° F. to about 50° F. above the critical temperature of the solvent.

The pressure level of second separation zone 22 is maintained at least equal to the vapor pressure of the first solvent when zone 22 is maintained at a temperature below the critical temperature of the first solvent and at least equal to the critical pressure of the first solvent when maintained at a temperature equal to or above the critical temperature of the first solvent. The pressure level in second separation zone 22 can be substantially the same as is maintained in first separation zone 18.

The second light phase is withdrawn from second separation zone 22 through a conduit 26 for recycle in the process to contact additional fresh feed. The second heavy phase can be introduced into an individual stripping zone (not shown) to strip at least a portion of any first solvent that may be contained therein. Preferably, the stripping zone comprises a steam stripping vessel. The first solvent thus recovered by stripping can be recycled in the process. The second heavy phase is withdrawn from second separation zone 22 through a conduit 24 and, after being freed of any contained first solvent, is recovered for beneficial use, for example, as liquid fuel or as feedstock to a hydrotreating process.

The first heavy phase is withdrawn from first separation zone 18 through a conduit 28 and introduced into a vis-breaking zone 30. In vis-breaking zone 30, the first heavy phase is heated to a temperature above 850° F. while being maintained at an elevated pressure to effect a conversion of the asphaltenes into lower molecular weight fragments. Preferably the temperature level is maintained above 900° F. and most preferably above 950° F. to effect an efficient cracking of the asphaltenes. The pressure level is controlled such that the pressure of the first heavy phase entering vis-breaking zone 30 and the pressure level of the products exiting zone 30 are both above the minimum pressure level required to prevent the formation of any separate vapor phase at any operating temperature level within zone 30. Such control of the pressure level prevents the formation of excessive amounts of coke and gas within vis-breaking zone 30 by substantially limiting the degree of degradation of the vis-breaking zone products. This control is monitored by measuring the pressure drop of the first heavy phase during its passage through vis-breaking zone 30 at temperatures below the cracking temperature of the asphaltenes and at temperatures above the cracking temperature of the asphaltenes. The pressure drop under these two different conditions is substantially unchanged when only a single condensed phase exists within zone 30. An increase in the pressure drop through zone 30 at temperatures above the cracking temperature of the asphaltenes indicates that a separate vapor phase is forming and that excess coke formation also probably has occurred.

The first heavy phase in vis-breaking zone 30 is converted into vis-breaking products comprising condensed hydrocarbon gases, if any are produced, distillable liquid products and substantially nondistillable liquid products including organometallic compounds. The vis-breaking products then pass from vis-breaking zone 30 through a conduit 32 into a third separation zone 34.

In third separation zone 34, the vis-breaking products are flashed to separate at least a portion of any gaseous and distillable liquid products including first solvent from the substantially nondistillable liquid products. The separated portion is withdrawn from third separation zone 34 through a conduit 36 and recovered. The separated first solvent can be recycled to first separation zone 18.

In an alternate embodiment of the present invention, the first heavy phase in conduit 28 can be treated (not shown) to separate at least a portion of any first solvent present for recycle to mixing zone 12. The removal of first solvent from the first heavy phase will cause a significant increase in the viscosity of the remaining asphaltenes and organometallic compounds in the first heavy phase. To facilitate cracking of the asphaltenes in the first heavy phase in vis-breaking zone 30, a diluent is added to the asphaltenes and organometallic compounds to reduce the viscosity of the mixture prior to entry into zone 30. The diluent is introduced into the mixture in conduit 28 through a conduit 56 in a quantity sufficient to reduce the viscosity of the mixture to a level at which it is easily flowable.

The diluent that is employed in practicing the invention is a highly aromatic petroleum by-product stream having a boiling temperature range of from about 400° F. to about 1000° F. The diluent can comprise a catalytic cracker recycle stock such as light catalytic cracker recycle oil, heavy catalytic cracker recycle oil or catalytic cracker slurry oil, thermally cracked petroleum stocks and lubricating oil aromatic extracts. Preferably the diluent will have a boiling temperature range of from about 400° F. to about 800° F. and most preferably a range of from about 400° F. to about 650° F.

The diluent imparts fluidity to the mixture of asphaltenes and organometallic compounds and facilitates heating of the mixture to the high temperatures necessary for cracking of the asphaltenes without an excessive production of coke, gases or light molecular fragments. The diluent generally is not itself thermally degraded in the vis-breaking process because it already is a product of a previous high temperature catalytic cracking conversion process. Catalytic cracker slurry oil is a particularly satisfactory diluent since it normally contains catalyst fines which act within vis-breaking zone 30 to improve the cracking rate and decrease those side reactions which tend to result in the formation of coke and gaseous products. The catalyst fines also tend to adsorb any metal values and other contaminants that may be released from the asphaltenes and organometallic compounds during the vis-breaking process.

The vis-breaking products and diluent are withdrawn from vis-breaking zone 30 and introduced into third separation zone 34 through conduit 32. The gases, distillable liquid products and diluent then are separated from the substantially nondistillable liquid products and organometallic compounds and withdrawn through conduit 36. A portion of diluent in conduit 36 can be recycled through a conduit 38 to contact fresh feed to vis-breaking zone 30.

In yet another embodiment of the present invention, in the event that the quantity of first solvent present in the first heavy phase is insufficient to provide the fluidity necessary for processing of the asphaltenes in vis-breaking zone 30, the diluent can be added to the first heavy phase without prior separation of the first solvent. The mixture of first heavy phase and diluent then is treated as previously described and the first solvent is recovered along with the diluent in third separation zone 34.

Irrespective of the operation of vis-breaking zone 30, the third heavy phase is withdrawn from third separation zone 34 through a conduit 40, contacted with a second solvent introduced through a conduit 42 and introduced into a fourth separation zone 44.

The second solvent is introduced in a quantity sufficient to provide a ratio of solvent to third heavy phase in the range of from about 2:1 to about 10:1. It is to be understood that larger quantities of the second solvent can be used, but such use is not particularly advantageous.

While specific reference has been made to a second solvent, it is to be understood that the second solvent can be the same as the first solvent or comprise any other fluid suitble for use as the first solvent.

In fourth separation zone 44, the mixture of third heavy phase and second solvent is separated into a fourth light phase comprising substantially nondistillable liquid products of the vis-breaking operation substantially free of organometallic compounds and second solvent and a fourth heavy phase comprising a residue which comprises residual asphaltenes, organometallic compounds, coke, catalyst fines, if any, and other heavy carbonaceous materials.

More particularly, fourth separation zone 44 is maintained at a temperature level in the range of from about 150° F. to about the critical temperature of the second solvent and a pressure level at least equal to the vapor pressure of the second solvent when at a temperature below the critical temperature of the second solvent and at least equal to the critical pressure of the second solvent when at a temperature equal to or above the critical temperature of the second solvent. Preferably, the temperature level is maintained within a range of from about 50° F. below the critical temperature of the second solvent to about 50° F. above the critical temperature of the second solvent. Preferably, the pressure level is maintained on above the critical pressure of the second solvent.

The fourth heavy phase is withdrawn from fourth separation zone 44 through a conduit 50 for recovery. The fourth heavy phase can be used as a solid feed to a gasifier or otherwise treated prior to disposal.

The fourth light phase is withdrawn from fourth separation zone 44 through a conduit 46 and introduced into a fifth separation zone 48. In fifth separation zone 48, the fourth light phase is maintained at an elevated temperature and pressure to effect a separation into a fifth light phase comprising second solvent and a fifth heavy phase comprising liquid products of the vis-breaking operation and some second solvent. The temperature level of fifth separation zone 48 is maintained at a level higher than the temperature level within fourth separation zone 44. The pressure level of fifth separation zone 48 is maintained at least equal to the vapor pressure of the second solvent when zone 48 is maintained at a temperature below the critical temperature of the second solvent and at least equal to the critical pressure of the second solvent when maintained at a temperature equal to or above the critical temperature of the second solvent. More particularly, the temperature level in fifth separation zone 48 preferably is maintained above the critical temperature of the second solvent and most preferably from about 5° F. to about 50° F. above the critical temperature of the second solvent.

The separated fifth light phase is passed from fifth separation zone 48 through a conduit 52 for recycle in the process.

The fifth heavy phase is withdrawn from fifth separation zone 48 through a conduit 54 and recovered for use as a liquid fuel generally being equivalent in utility to No. 6 fuel oil.

The fourth and fifth heavy phases can be introduced into individual stripping zones (not shown) to strip at least a portion of any second solvent that may be contained in the respective heavy phases. Preferably the stripping zones would comprise steam stripping vessels. The second solvent then can be recycled in the process.

In an alternate embodiment of the present invention, fifth separation zone 48 can comprise a flash zone in which the fourth light phase is flashed to a sufficiently reduced pressure to form at least one stream comprising the liquid products of the vis-breaking operation and one other stream comprising second solvent. The liquid products then are recovered and the solvent is recycled as previously described.

To further illustrate the process of this invention and not by way of limitation, the following examples are provided.

EXAMPLE I

A reduced crude comprising 18 percent asphaltenes, 30 percent resins and 52 percent oils, by weight, having a softening point of about 110° F., is admixed with a first solvent comprising n-pentane in a volume ratio (measured at 60° F.) of solvent to feed of about 10:1 and introduced into a first separation zone 18. The first separation zone is maintained at a temperature level of about 370° F. and a pressure level of about 650 psig. The feed mixture separates into a first light phase and a first heavy phase comprising asphaltenes and some n-pentane.

The n-pentane is separated from the first heavy phase by flashing and the remainder of the heavy phase is admixed with a diluent comprising catalytic cracker slurry oil in a ratio of diluent to feed of about 3:1 to form a mixture which is introduced into a vis-breaking zone 30. The mixture is heated to a temperature of about 950° F. in vis-breaking zone 30 while maintained at a pressure level of about 500 psig. to prevent the formation of a separate vapor phase within vis-breaking zone 30. The products of the vis-breaking zone are introduced into a third separation zone comprising a flash zone to separate distillable liquid products from any substantially nondistillable liquid products and organometallic compounds. The nondistillable liquid products and organometallic compounds then are contacted with a second solvent comprising n-hexane in a ratio of solvent to feed of about 8:1 to form a mixture that is introduced into a fourth separation zone 44.

The fourth separation zone is maintained at a temperature level of about 450° F. and a pressure level of about 650 psig. to effect a separation of the mixture present therein into a fourth light phase and a fourth heavy phase comprising a residue including organometallic compounds. The fourth light phase then is introduced into a fifth separation zone 48 comprising a flash zone wherein the pressure level on the fourth light phase is reduced to about atmospheric pressure to vaporize the second solvent and form a stream of liquid products. The liquid products have a reduced metals content and are comparable in quality to a No. 6 fuel oil.

EXAMPLE II

The reduced crude of Example I is admixed with a first solvent comprising cyclohexane in a volume ratio of solvent to feed of 20:1 and introduced into first separation zone 18. The first separation zone is maintained at a temperature level of about 500° F. and a pressure level of about 650 psig. The feed mixture separates into a first light phase and a first heavy phase comprising asphaltenes and some pentane.

The first heavy phase then is admixed with a diluent comprising catalytic cracker slurry oil in a ratio of diluent to feed of about 3:1 to form a mixture which is introduced into a vis-breaking zone 30. The mixture is heated to a temperature of about 950° F. in vis-breaking zone 30 while maintained at a pressure level of about 500 psig. to prevent the formation of a separate vapor phase within vis-breaking zone 30. The products of vis-breaking zone 30 then are introduced into a third separation zone comprising a flash zone to separate distillable liquid products from any substantially nondistillable liquid products and organometallic compounds. The nondistillable liquid products and organometallic compounds then are contacted with a second solvent comprising benzene in a ratio of solvent to feed of about 7:1 to form a mixture that is introduced into a fourth separation zone 44.

The fourth separation zone is maintained at a temperature level of about 545° F. and a pressure level of about 750 psig. to effect a separation of the mixture into a fourth light phase and a fourth heavy phase comprising a residue including organometallic compounds. The fourth light phase then is introduced into a fifth separation zone maintained at a temperature level of about 575° F. and a pressure level of about 725 psig. The fourth light phase is caused to separate into a fifth light phase comprising second solvent and a fifth heavy phase comprising liquid products of the vis-breaking operation and some second solvent. The fifth heavy phase then is steam stripped to separate the remaining second solvent from the liquid products. The liquid products have a reduced metals content and are comparable in quality to a No. 6 fuel oil.

The foregoing examples illustrate the means by which the present invention can be used to increase the yield of useful liquid products recovered from a heavy hydrocarbon material.

The term "heavy hydrocarbon material" as used herein means pyrogenous bitumens, native bitumens or one or more fractions or components thereof. The pyrogenous bitumens include heavy or very low API gravity petroleum crudes, reduced crudes, either steam or vacuum refined, hard and soft wood pitches, coal tar residues, cracked tars, tall oil and the like. The native bitumens include gilsonite, wurtzilite, albertite and native asphalt, for instance, Trinidand asphalt and the like.

The term "liquid phase product" as used herein means a product that exhibits a characteristic readiness to flow at process conditions.

While the invention has been described with respect to what at present are preferred embodiments thereof, it will be understood, of course, that certain changes, substitutions, modifications and the like may be made therein without departing from its true scope as defined in the appended claims.

What is claimed is:

1. A process comprising:

introducing a heavy hydrocarbon material comprising oils, resins, asphaltenes and associated organometallic compounds and a first solvent into a first separation zone maintained at an elevated temperature and pressure level to effect a separation of said heavy hydrocarbon material and first solvent into a first light phase including first solvent and a first heavy phase comprising asphaltenes, organometallic compounds and some first solvent;

recovering first solvent from said first light phase in a second separation zone;

introducing said first heavy phase into a vis-breaking zone maintained at an elevated temperature and pressure level to crack said asphaltenes in said first heavy phase to produce distillable and substantially nondistillable liquid vis-broken products including organometallic compounds, said pressure level being such that substantially a single condensed phase exists within said vis-breaking zone;

introducing said distillable and substantially non-distillable liquid products from said vis-breaking zone into a third separation zone to separate at least a portion of said distillable liquid products from the remainder;

introducing said remainder from said third separation zone and a second solvent into a fourth separation zone maintained at an elevated temperature and pressure to effect a separation of said mixture into a fourth light phase comprising nondistillable liquid products substantially free of organometallic compounds, any distillable liquid products present and second solvent and a fourth heavy phase comprising a residue including organometallic compounds and some second solvent; and

2. The process of claim 1 wherein said first solvent comprises at least one member selected from the group consisting of paraffin hydrocarbons containing from 4 through 9 carbon atoms, cycloparaffin hydrocarbons containing fewer than 10 carbon atoms and mono-olefin hydrocarbons containing from 4 through 8 carbon atoms.

3. The process of claim 1 wherein said second solvent comprises at least one member selected from the group consisting of paraffin hydrocarbons containing from 4 through 9 carbon atoms, cycloparaffin hydrocarbons containing fewer than 10 carbon atoms and mono-olefin hydrocarbons containing from 4 through 8 carbon atoms.

4. The process of claim 1 wherein the first separation zone is maintained at an elevated temperature and pressure defined further as:

maintaining said first separation zone at a temperature level in the range of from about 150° F. to above the critical temperature of the first solvent and a pressure level at least equal to the vapor pressure of the first solvent at temperatures below the critical temperature of the first solvent and at least equal to the critical pressure of the first solvent at temperatures equal to or above the critical temperature of the first solvent.

5. The process of claim 1 wherein the fourth separation zone is maintained at an elevated temperature and pressure defined further as:

maintaining said fourth separation zone at a temperature level in the range of from about 150° F. to above the critical temperature of the second solvent and a pressure level at least equal to the vapor pressure of the second solvent at temperatures below the critical temperature of the second solvent and at least equal to the critical pressure of the second solvent at temperatures equal to or above the critical temperature of the second solvent.

6. The process of claim 1 defined further to include the steps of:

introducing said fourth light phase into a fifth separation zone maintained at a temperature level above the temperature level of said third separation zone and at an elevated pressure level to effect a separation of said fourth light phase into a fifth light phase comprising second solvent and a fifth heavy phase comprising substantially nondistillable liquid products and any remaining distillable liquid products that were produced in said vis-breaking zone; and recovering said fifth heavy phase.

7. The process of claim 6 wherein the fifth separation zone is maintained at a temperature level above the temperature level of the fourth separation zone defined further as:

maintaining said fifth separation zone at a temperature level in the range of from about 5° F. to about 100° F. higher than the temperature level in said fourth separation zone.

8. The process of claim 6 wherein the fifth separation zone is maintained at a temperature level above the critical temperature of the second solvent.

9. The process of claim 1 wherein the first separation zone is maintained at a temperature level above the critical temperature of the first solvent.

10. The process of claim 1 defined further to include the steps of:

flashing said fourth light phase to form at least one stream comprising second solvent and one other stream comprising substantially nondistillable liquid products from said visbreaking zone having a reduced metals content; and recovering said substantially nondistillable liquid products.

11. The process of claim 1 defined further to include the step of:

recovering second solvent from said fourth light phase in a fifth separation zone.

12. A process comprising:

introducing a heavy hydrocarbon material comprising oils, resins, asphaltenes and associated organometallic compounds and a first solvent into a first separation zone maintained at an elevated temperature and pressure level to effect a separation of said heavy hydrocarbon material and first solvent into a first light phase including first solvent and a first heavy phase comprising asphaltenes, organometallic compounds and some first solvent;

recovering first solvent from said first light phase in a second separation zone;

admixing said first heavy phase with a diluent comprising a hydrocarbon to form a mixture;

introducing said mixture into a vis-breaking zone maintained at an elevated temperature and pressure level to crack said asphaltenes in said first heavy phase to produce distillable and substantially nondistillable liquid vis-broken products including said organometallic compounds in association with said diluent, said pressure level within said visbreaking zone being sufficient that substantially a single condensed phase exists within said vis-breaking zone;

separating at least a portion of said diluent and distillable liquid products from said substantially nondistillable liquid products;

introducing said substantially nondistillable liquid products and a second solvent into a third separation zone maintained at an elevated temperature and pressure level to effect a separation of said same into a third light phase comprising substantially nondistillable liquid products substantially free of organometallic compounds and a second solvent and a third heavy phase comprising a residue including organometallic compounds; and recovering said substantially nondistillable liquid products of said third light phase.

13. The process of claim 12 wherein said first solvent comprises at least one member selected from the group consisting of paraffin hydrocarbons containing from 4 through 9 carbon atoms, cycloparaffin hydrocarbons containing fewer than 10 carbon atoms and mono-olefin hydrocarbons containing from 4 through 8 carbon atoms.

14. The process of claim 12 wherein said second solvent comprises at least one member selected from the group consisting of paraffin hydrocarbons containing from 4 through 9 carbon atoms, cycloparaffin hydrocarbons containing fewer than 10 carbon atoms and mono-olefin hydrocarbons containing from 4 through 8 carbon atoms.

15. The process of claim 12 wherein the first separation zone is maintained at an elevated temperature and pressure level defined further as:

maintaining said first separation zone at a temperature level in the range of from about 150° F. to above the critical temperature of the first solvent and a pressure level at least equal to the vapor pressure of the first solvent at temperatures below the critical temperature of the first solvent and at least equal to the critical pressure of the first solvent at temperatures equal to or above the critical temperature of the first solvent.

16. The process of claim 12 wherein the third separation zone is maintained at an elevated temperature and pressure level defined further as:

maintaining said third separation zone at a temperature level in the range of from about 150° F. to above the critical temperature of the second solvent and a pressure level at least equal to the vapor pressure of the second solvent at temperatures below the critical temperature of the second solvent and at least equal to the critical pressure of the second solvent at temperatures equal to or above the critical temperature of the second solvent.

17. The process of claim 12 in which the first solvent and second solvent are the same.

18. The process of claim 12 defined further to include the step of:

separating at least a portion of said first solvent from said first heavy phase prior to admixing said first heavy phase with said diluent.

19. The process of claim 12 wherein the temperature level and pressure level of the third separation zone is maintained above the critical temperature and pressure of the second solvent.

20. The process of claim 12 wherein the diluent consists essentially of a hydrocarbon fraction having a boiling temperature range of from about 400° F. to about 1000° F.

21. A process comprising:

admixing a hydrocarbon material comprising asphaltenes and associated organometallic compounds with a diluent to form a mixture;

introducing said mixture into a vis-breaking zone maintained at an elevated temperature and pressure level to crack said asphaltenes in said mixture to produce vis-breaking products comprising distillable and substantially nondistillable liquid vis-broken products including said organometallic compounds in association with said diluent, said pressure level within said vis-breaking zone being sufficient that substantially a single condensed phase exists within said vis-breaking zone;

separating at least a portion of said diluent and distillable liquid products from said substantially nondistillable liquid products of said vis-breaking;

admixing said substantially nondistillable liquid products with a solvent to form a second mixture;

introducing said second mixture into a separation zone maintained at an elevated temperature and pressure level to effect a separation of said second mixture into a light phase comprising substantially nondistillable liquid products substantially free of organometallic compounds and solvent and a heavy phase comprising a residue including said organometallic compounds; and recovering said substantially nondistillable liquid products of said light phase.

22. The process of claim 21 wherein said diluent consists essentially of a hydrocarbon fraction having a boiling temperature range of from about 400° F. to about 1000° F.

23. The process of claim 21 wherein said solvent comprises at least one member selected from the group consisting of paraffin hydrocarbons containing from 4 through 9 carbon atoms, cycloparaffin hydrocarbons containing fewer than 10carbon atoms and mono-olefin hydrocarbons containing from 4 through 8 carbon atoms.

24. The process of claim 21 wherein the elevated temperature level and pressure level of said separation zone is defined further as a temperature level in the range of from about 150° F. to above the critical temperature of the solvent and a pressure level at least equal to the vapor pressure of the solvent at temperatures below the critical temperature of the solvent and at least equal to the critical pressure of the solvent at temperatures equal to or above the critical temperature of the solvent.

25. The process of claim 21 wherein separating at least a portion of said diluent and distillable liquid products from said substantially nondistillable liquid products and residue of said vis-breaking products is effected by flashing said vis-breaking products to a sufficiently low pressure level to produce at least one overhead stream comprising at least a portion of said diluent and distillable liquid products and one other stream comprising said substantially nondistillable liquid products.

* * * * *